US008006603B2

(12) United States Patent
Gardwood

(10) Patent No.: US 8,006,603 B2
(45) Date of Patent: Aug. 30, 2011

(54) ACCESS DOOR FOR FEEDER/DELINKER OF A GATLING GUN

(76) Inventor: Tracy W Gardwood, Scottsdale, AZ (US)

( * ) Notice: Subject to any disclaimer, the term of this patent is extended or adjusted under 35 U.S.C. 154(b) by 42 days.

(21) Appl. No.: 12/316,349

(22) Filed: Dec. 11, 2008

(65) Prior Publication Data

US 2009/0235812 A1 Sep. 24, 2009

Related U.S. Application Data

(60) Provisional application No. 61/007,565, filed on Dec. 13, 2007.

(51) Int. Cl.
*F41A 35/00* (2006.01)

(52) U.S. Cl. ..... 89/9

(58) Field of Classification Search ..... 89/9, 12, 89/13.05

See application file for complete search history.

(56) References Cited

U.S. PATENT DOCUMENTS

| | | | | | |
|---|---|---|---|---|---|
| 499,534 | A * | 6/1893 | Gatling | 89/33.17 |
| 2,399,904 | A * | 5/1946 | Baucum | 42/89 |
| 3,766,821 | A * | 10/1973 | Cozzy et al. | 89/12 |
| 5,809,359 | A * | 9/1998 | Taku | 396/513 |

* cited by examiner

*Primary Examiner* — Stephen M Johnson
(74) *Attorney, Agent, or Firm* — Tod R. Nissle, P.C.

(57) ABSTRACT

The feeder/delinker of a Gatling gun is provided with an access system which includes a unitary access door and a plunger mounted in the access door. When the access door is partially opened, the plunger is deployed and contacts and secures a cartridge in the feeder/delinker so that a user can remove his hand from the feeder/delinker prior to completely closing the access door. When the access door is closed, the plunger retracts into and is stored in the access door.

1 Claim, 8 Drawing Sheets

ACCESS DOOR FOR FEEDER/DELINKER OF A GATLING GUN

This application claims priority based on provisional patent application Ser. No. 61/007,565, filed Dec. 13, 2007.

I have discovered a new access door 10 for the feeder/delinker of a Gatling gun. The access door 10 is illustrated in the attached FIGS. 1 to 8.

Figure 1:
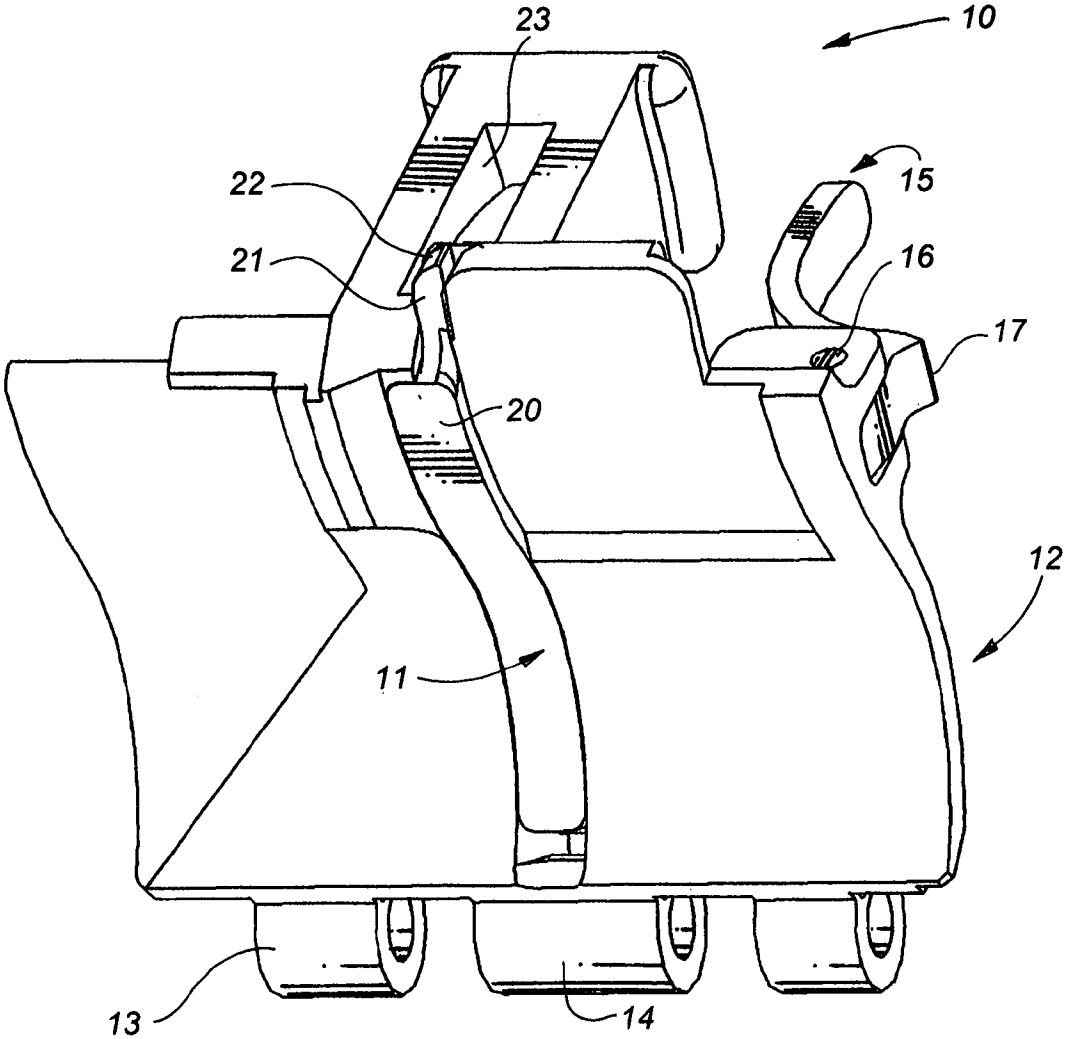
FIG. 1 is a bottom perspective view illustrating the access door.

FIGS. 1 to 4 illustrate the access door 10 removed from the feeder/delinker housing 30. Door 10 includes base 12 and a plunger 11. Plunger 11 is pivotally spring loaded on base 12 in slot or opening 23 formed in base 12.

Figure 2:
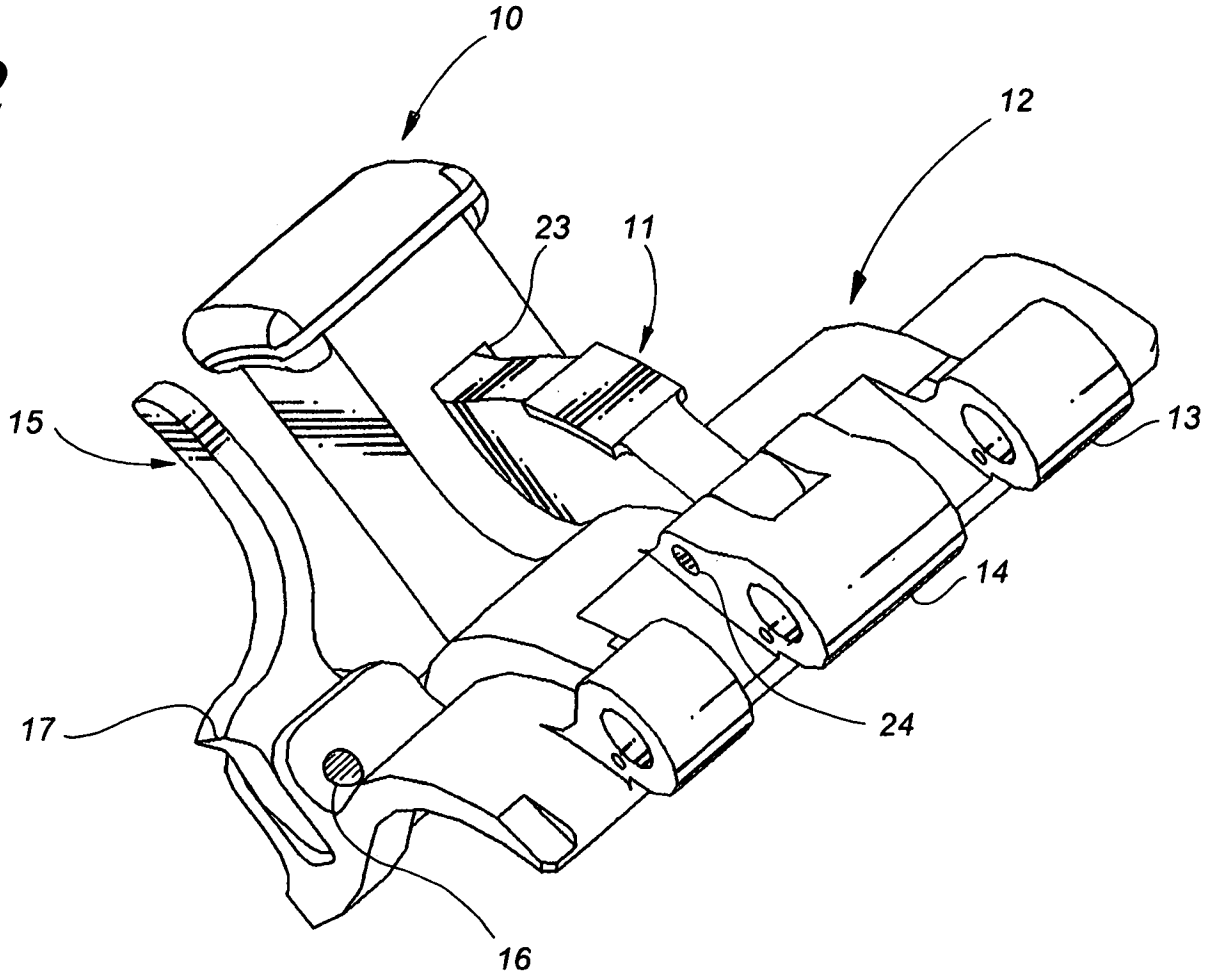
FIG. 2 is a left rear perspective view illustrating the access door.
Figure 3:
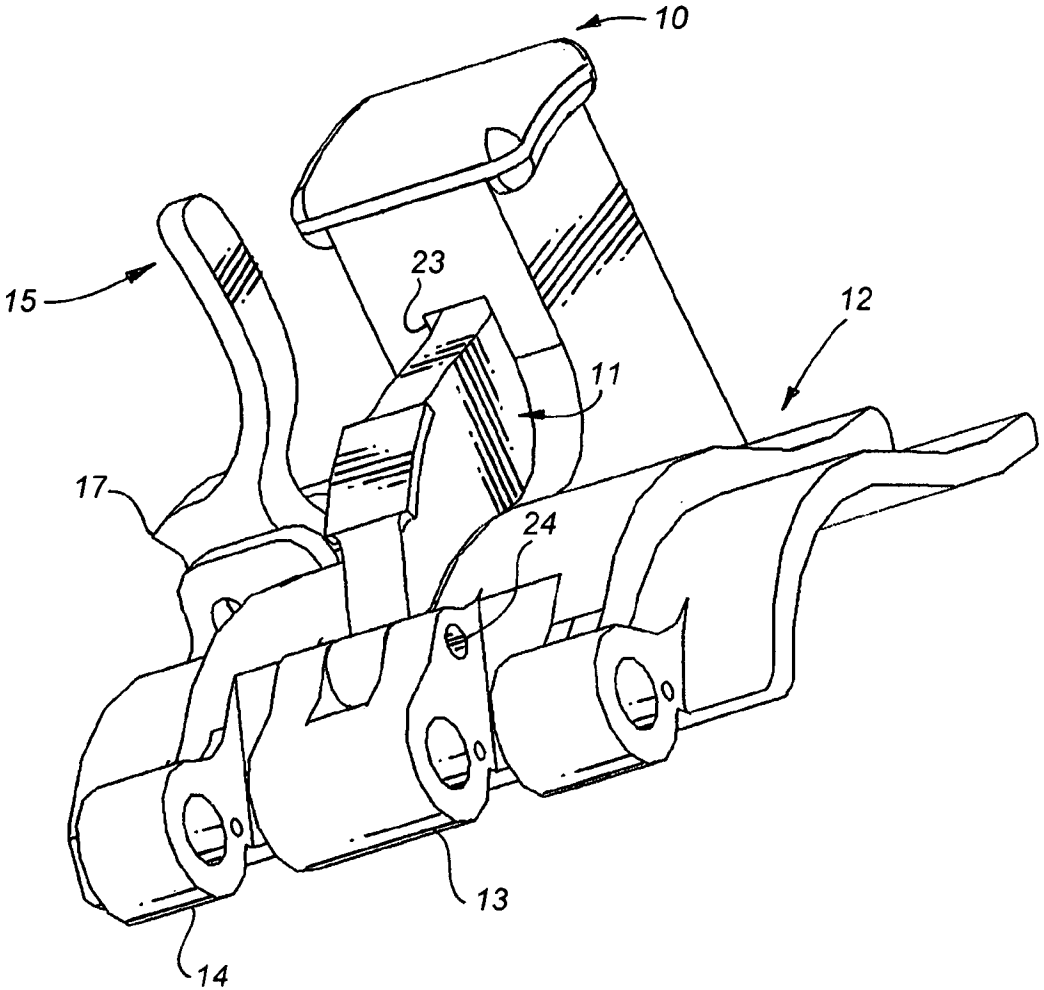
FIG. 3 is a right rear perspective view illustrating the access door.
Figure 7:
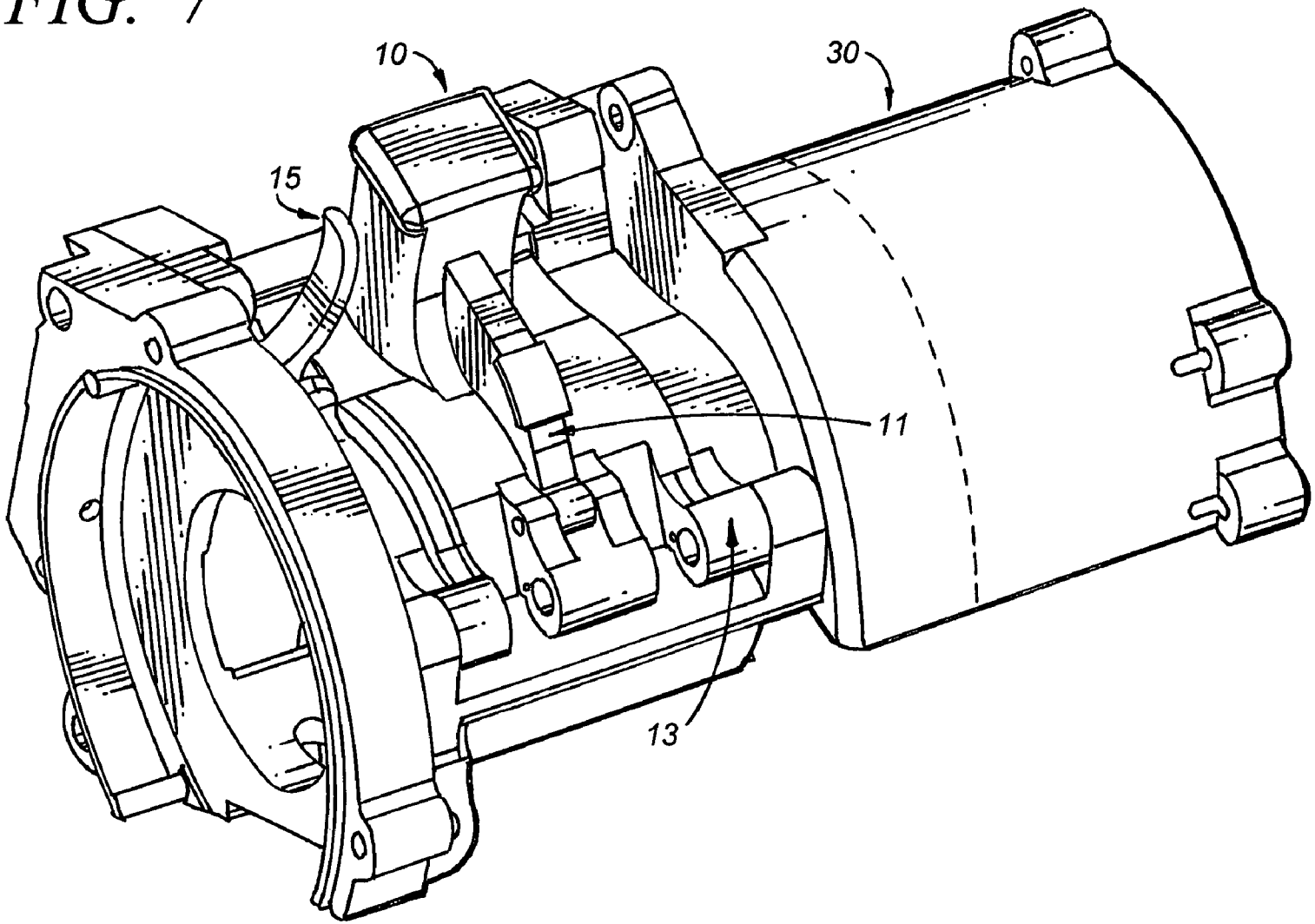
FIG. 7 is a perspective view further illustrating the mode of operation of the access door; and, FIG. 8 is a perspective view further illustrating the mode of operation of the access door.
Figure 8:
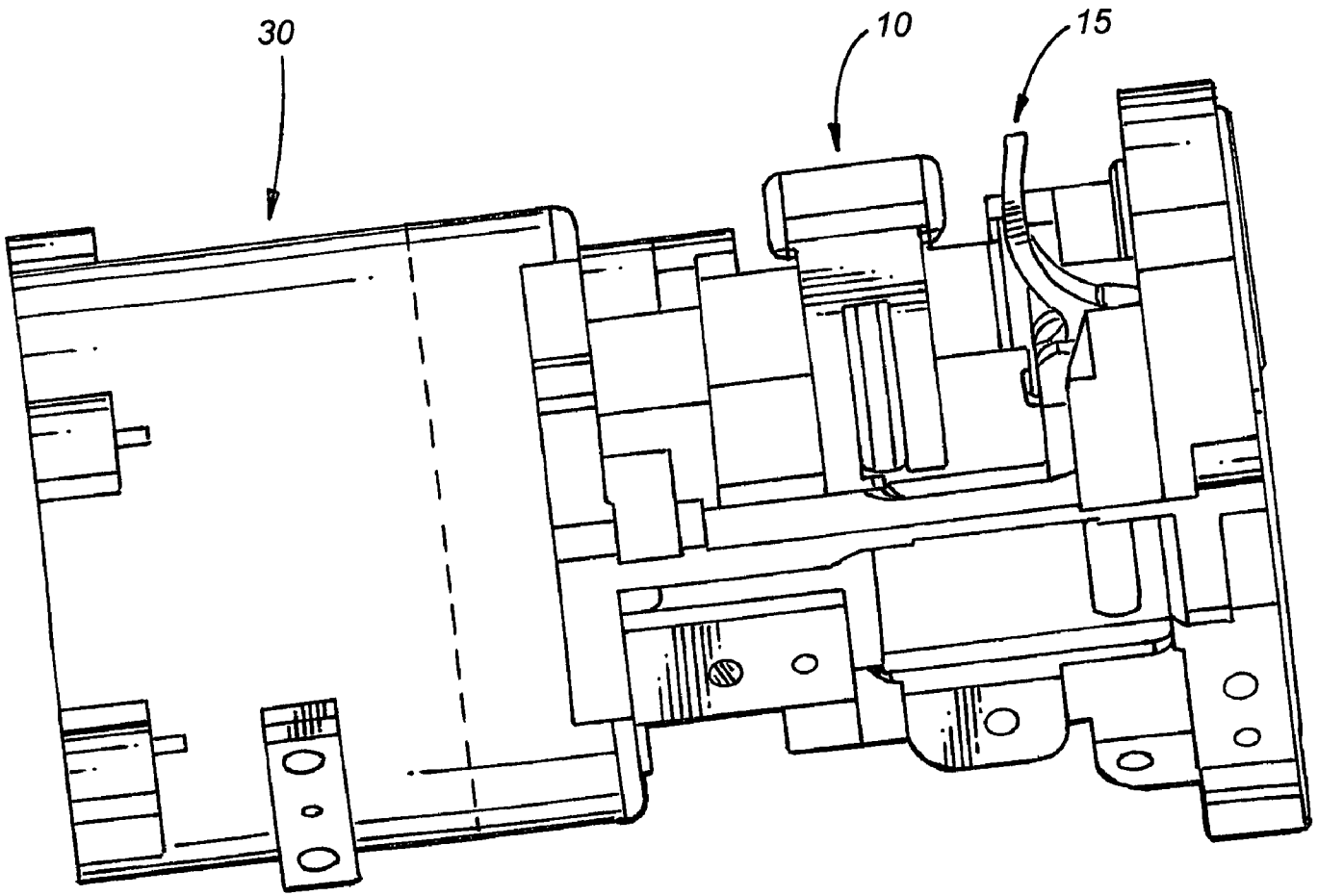

In FIGS. 1 to 3, the plunger 11 is shown in the retracted position in base 12. Plunger 11 is in the retracted position when the access door 10 is in the closed position in housing 30. The access door 10 is shown in the closed position in housing 30 in FIGS. 6 to 8.

Figure 4:
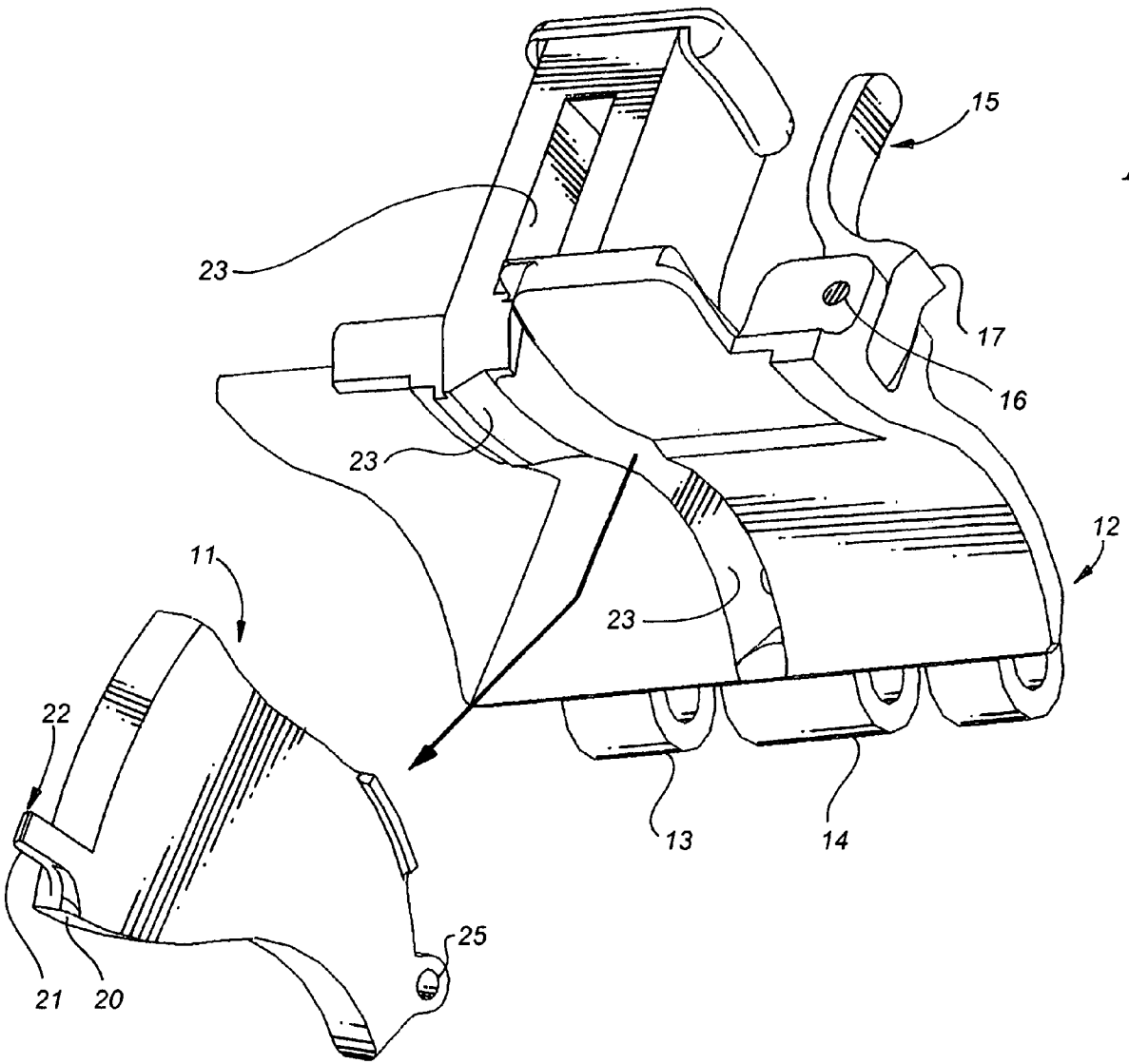
FIG. 4 is a bottom exploded perspective view illustrating the access door.

Plunger 11 includes a bottom surface including portion 20 which bears against a cartridge 40 when door 10 is in the partially closed position, and includes a stop tab 22 with bottom surface 21. Plunger 11 also includes opening 25 formed there through (FIG. 4). As shown in FIG. 2, pin 24 extends through opening 25 to pivotally mount plunger 11 on base 12. A control spring (not shown) associated with plunger 11 and base 12 functions to generate a force that causes plunger 11 to pivot about pin 16 and that displaces plunger 11 to the deployed position of FIG. 5 when door 10 is in the partially opened position illustrated in FIG. 5 (or when door 10 is in the completely opened position). When access door 10 is in the partially opened position illustrated in FIG. 5, portion 20 of the bottom surface of plunger 11 contacts cartridge 40; and, continuing to move door 10 in the direction of arrow A from the partially opened position of FIG. 5 to the closed position of FIG. 6 overcomes the forces generated by the control spring and forces plunger back inside slot 23 and base 12 to the position illustrated in FIGS. 6 to 8 and 1 to 3.

Release lever 15 is also pivotally spring loaded on base 12 and includes tooth or lip 17. Pin 16 extends through aperture 16A (FIG. 5) and through lever 15 to pivotally mount lever 15 on base 12. When the access door 10 is in the closed position illustrated in FIG. 6, lip 17 engages opening 17A and prevents the access door 10 from opening.

FIG. 4 is an exploded view of the access door 10 illustrating plunger 11 removed from base 12.

Figure 5:
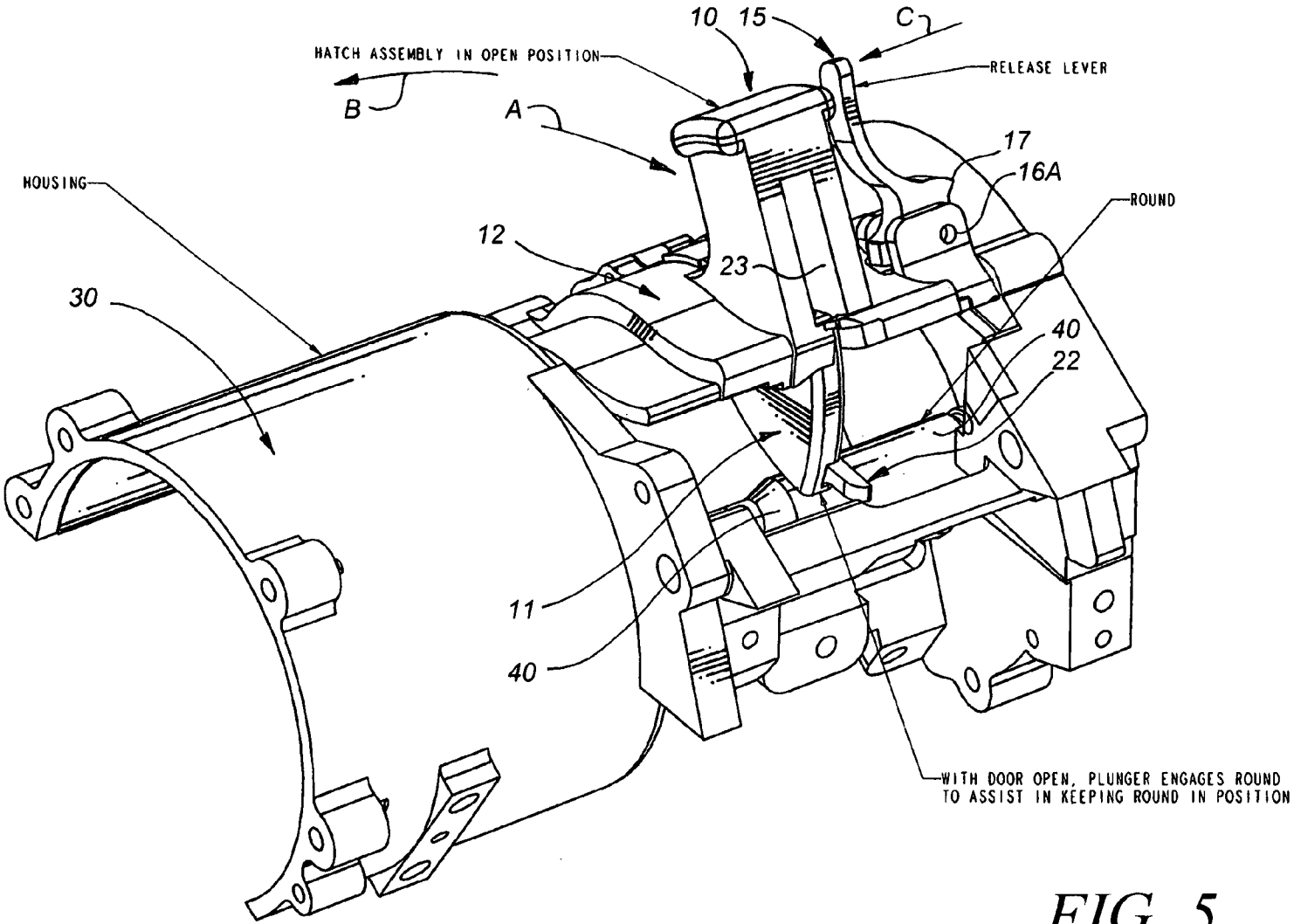
FIG. 5 is a perspective view illustrating the mode of operation of the access door.

Door 10 can be opened in the direction of arrow B (FIG. 5) past the position of door 10 illustrated in FIG. 5 to a completely opened position to allow greater access to the interior of the feeder/delinker so a user can position a cartridge 40 in the interior of the feeder/delinker.

Figure 6:
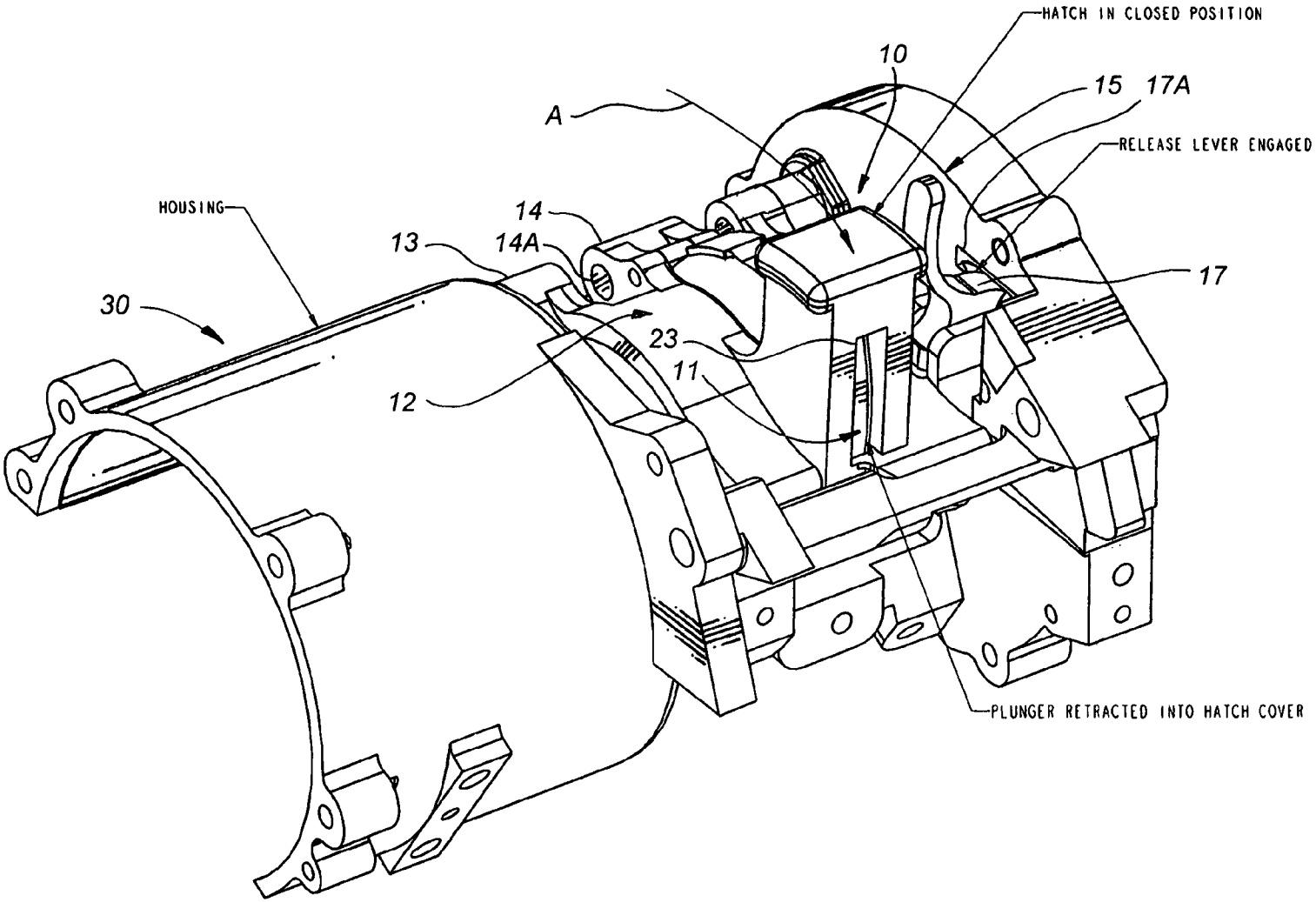
FIG. 6 is a perspective view further illustrating the mode of operation of the access door.

In use, a user manually displaces lever 15 inwardly in the direction of arrow C to disengage lip 17 from opening 17A and then opens door 10 in the direction of arrow B from the closed position of FIG. 6 to a completely open position to allow access to the interior of the feeder/delinker. The user positions a cartridge 40 in the interior of the feeder/delinker in the position illustrated in FIG. 5, places with one hand a finger(s) on cartridge 40 to hold the cartridge in place, moves with the other hand door 10 from the completely opened position to the partially opened position of FIG. 5 such that the portion 20 of the bottom surface of plunger 11 rests on and holds cartridge in place in the manner illustrated in FIG. 5, removes his finger(s) from cartridge 40, and then moves door 10 from the partially opened position of FIG. 5 to the closed position of FIG. 6 such that lip 17 snaps into opening 17A and holds door 10 in the closed position.

Having described the invention in such terms as to enable one of skill in the art to make and use the invention, I claim:

1. In combination with the feeder/delinker of a Gatling machine gun, the feeder/linker including a housing, an interior, and a cartridge positioned in the interior, the improvements comprising an access system comprising a unitary door (10) pivotally mounted in said housing and including (a) a slot (23); and (b) a plunger (11) pivotally mounted in said door and including a deployable portion and a cartridge-contact bottom surface (20), said plunger movable between at least two operative positions, (i) a first stowed operative position with said plunger (11) retracted and housed in said slot (23) of said door (10), and (ii) a second deployed operative position with said deployable portion of said plunger (11) extending outwardly from said slot (23) and said door (10), said door (10) movable between at least three operative positions, (i) a first completely open operative position with said plunger in said second deployed operative position and said cartridge-contact bottom surface (20) spaced apart from the cartridge, (ii) a second partially open operative position with said plunger in said second deployed operative position and said cartridge-contact bottom surface (20) contacting the cartridge, and (iii) a third closed operative position with said plunger in said first stowed operative position.

* * * * *

UNITED STATES PATENT AND TRADEMARK OFFICE

CERTIFICATE OF CORRECTION

PATENT NO. : 8,006,603 B2
APPLICATION NO. : 12/316349
DATED : August 30, 2011
INVENTOR(S) : Tracy W. Garwood It is certified that error appears in the above-identified patent and that said Letters Patent is hereby corrected as shown below:

Title page, beneath "(12) United States Patent", "Gardwood" should read "Garwood".

Title page, Item "(76) Inventor", "Tracy W. Gardwood" should read "Tracy W. Garwood".

Signed and Sealed this
Twenty-fifth Day of October, 2011

David J. Kappos

David J. Kappos
*Director of the United States Patent and Trademark Office*